US010900761B2

(12) United States Patent
Blache et al.

(10) Patent No.: US 10,900,761 B2
(45) Date of Patent: Jan. 26, 2021

(54) MUNITION AND LOGISTICS CONCEPT FOR, IN PARTICULAR, ARTILLERY PROJECTILES

(71) Applicant: RHEINMETALL WAFFE MUNITION GMBH, Unterluess (DE)

(72) Inventors: Andreas Blache, Loerrach (DE); Ralf Aumund-Kopp, Lueneburg (DE); Frank Guischard, Celle (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 16/571,774

(22) Filed: Sep. 16, 2019

(65) Prior Publication Data

US 2020/0025542 A1 Jan. 23, 2020

Related U.S. Application Data

(63) Continuation of application No. PCT/EP2018/055617, filed on Mar. 7, 2018.

(30) Foreign Application Priority Data

Mar. 15, 2017 (DE) ..... 10 2017 105 565

(51) Int. Cl.
*F42B 33/00* (2006.01)
*F42B 33/02* (2006.01)
(Continued)

(52) U.S. Cl.
CPC ..... *F42B 33/001* (2013.01); *F42B 33/0207* (2013.01); *F42B 10/38* (2013.01); *F42B 12/02* (2013.01)

(58) Field of Classification Search
CPC .... F42B 33/001; F42B 33/0207; F42B 10/38; F42B 12/02
(Continued)

(56) References Cited

U.S. PATENT DOCUMENTS 4,781,117 A * 11/1988 Garnett ..... F42B 12/24 102/374
4,930,420 A 6/1990 Meffert et al.
(Continued)

FOREIGN PATENT DOCUMENTS

CA 2 458 268 A1 8/2004
DE 38 19 640 A1 12/1989
(Continued)

*Primary Examiner* — John Cooper
(74) *Attorney, Agent, or Firm* — Muncy, Geissler, Olds & Lowe, P.C.

(57) ABSTRACT

A uniform projectile casing which is utilized for projectiles with different ranges. A projectile of relatively short range can in this case be optimized with regard to payload, whereas a projectile with the relatively long range is subjected to a range optimization, with a reduction in payload. The payload of a projectile of relatively long range is generally lower in relation to a projectile with relatively short range. The artillery projectiles have a projectile casing of equal size for the projectiles of different range. To create an artillery projectile, for example 155 mm, a uniform payload-optimized 30 km projectile casing) is used, from which 40 km projectiles can be generated (produced, assembled) by means of a reduction in payload. The range is selected and defined by mutually different projectile bases. The artillery projectile has multiple modular parts which are assembled in order to create the artillery projectile.

15 Claims, 2 Drawing Sheets

(51) Int. Cl.
*F42B 10/38* (2006.01)
*F42B 12/02* (2006.01)

(58) Field of Classification Search
USPC ..... 102/501, 503; 86/20.14, 51; 89/1.35, 89/1.11
See application file for complete search history.

(56) References Cited

U.S. PATENT DOCUMENTS 5,238,204 A * 8/1993 Metz ..... F42B 10/661 244/3.15
6,186,072 B1 * 2/2001 Hickerson, Jr. ..... F42B 12/06 102/517
6,666,146 B2 12/2003 Wardecki et al.
7,506,587 B1 * 3/2009 Anderson ..... F42B 10/40 102/473
8,191,479 B2 * 6/2012 Ruhlman ..... F42C 19/09 102/396
8,546,736 B2 * 10/2013 Dryer ..... F42B 10/661 244/3.21
9,587,921 B2 * 3/2017 Faxon ..... F42B 33/00
9,810,513 B2 * 11/2017 Kerns ..... F42B 12/204
2003/0167956 A1 * 9/2003 Kellner ..... F42B 12/208 102/517
2004/0069176 A1 * 4/2004 Kellner ..... F42B 12/204 102/476
2004/0200375 A1 * 10/2004 Kautzsch ..... F42B 10/16 102/385
2006/0272538 A1 * 12/2006 Janik ..... F42B 5/067 102/473
2010/0199875 A1 * 8/2010 Weihrauch ..... F42B 12/204 102/492
2012/0181375 A1 7/2012 Dryer
2012/0227609 A1 * 9/2012 Volkmann ..... F42B 12/02 102/322

FOREIGN PATENT DOCUMENTS

DE 101 00 397 A1 7/2002
DE 101 05 867 B4 3/2004
DE 103 08 307 B4 1/2007
DE 10 2011 010 183 A1 8/2012
DE 10 2013 021 030 A1 6/2015
DE 10 2014 109 077 A1 12/2015
DE 102015003324 A1 9/2016
EP 2 405 233 A2 1/2012

* cited by examiner

MUNITION AND LOGISTICS CONCEPT FOR, IN PARTICULAR, ARTILLERY PROJECTILES

This nonprovisional application is a continuation of International Application No. PCT/EP2018/055617, which was filed on Mar. 7, 2018, and which claims priority to German Patent Application No. 10 2017 105 565.7, which was filed in Germany on Mar. 15, 2017, and which are both herein incorporated by reference.

BACKGROUND OF THE INVENTION

Field of the Invention

The present invention relates to a munition concept, in particular for artillery munitions, which enables a customer- or user-specific structure of an artillery munition with a low storage outlay.

Description of the Background Art

In the case of an artillery munition, a detonator and warhead form the projectile. These projectiles can be of different configurations depending on the task of the artillery munition. In terms of this task, the projectiles for the artillery munition are divided into explosive, training, luminous, effect and smoke projectiles.

DE 103 08 307 B4 describes a smoke projectile with a projectile casing and submunitions lying on top of one another therein for accommodating the active mass. The structure of a further smoke projectile can be inferred from DE 101 05 867 B4, which corresponds to U.S. Pat. No. 6,666,146.

DE 101 00 397 A1 describes a ballistic training projectile with a nose detonator and a base which can close off the projectile casing at the rear side. DE 10 2011 010 183 A1 discloses an explosive training projectile which has a multi-part cargo projectile casing. The aim is to be able to use existing projectile casings which are not used further.

Since modern artillery is only able to cover the wide spectrum of targets with a balanced munitions mix with high efficiency for various scenarios, in practice munition families with various ranges, e.g. 30 km max. range or 40 km max. range, are offered. Some suppliers give users the option of being able to choose between an artillery munition with, for example, 30 km max. range or 40 km max. range.

If such a munition family is used, there arise significant restrictions in performance in the case of a 40 km artillery munition as a result of lower payload volume and/or quantities in comparison with a conventional 30 km artillery munitions. This restriction in performance must currently be accepted by the user. The users therefore invest in larger munition allocations (storage) for the possibility of selection—30 km or 40 km max. range. In practice, this leads to a larger stock being required and the munitions aging. In order to ensure that they are functioning, munition inspections are also carried out at regular intervals.

SUMMARY OF THE INVENTION

It is therefore an object of the present invention to provide a munition concept and an associated logistics concept which avoid the above-mentioned disadvantages.

The logistics concept arises from a new munition concept, based on the idea of creating a munitions construction kit in order to enable a customer- or user-specific structure of an artillery munition, in particular of an artillery projectile, alongside low storage outlay.

The use of a uniform projectile casing which is used for projectiles with various ranges is proposed. A projectile with a shorter range can be payload-optimized, while a projectile with the greater range is subject to range optimization alongside payload reduction. The payload of a projectile with a greater range is generally smaller than in the case of a projectile with a shorter range. The artillery projectiles have a projectile casing of the same size for the projectiles with different ranges. I.e., for the creation of an artillery projectile, e.g. 155 mm, a uniform payload-optimized 30 km projectile casing is used, from which 40 km projectiles with payload reduction can be generated (produced, assembled). The range is selected and specified by varying projectile base types.

The artillery projectile is composed of several construction kit parts which are assembled to create the artillery projectile.

The munitions construction kit comprises individual construction kit parts or construction kit modules (=components) which represent self-enclosed units. The key component of the proposed munitions construction kit and basis of the munitions construction kit is a uniform projectile casing for the projectiles with various ranges. The projectile casing preferably has identical outer ballistics for each range group, shorter range, for example 30 km, longer range, for example 40 km. The projectile casing can have one part to n parts.

A projectile base can be fastened to this projectile casing at the tail side, for example by means of screwing. The munitions kit according to the invention includes two different projectile bases. These serve to adjust the range of the projectile. For this adjustment, a projectile base without reduction of the CW value by reducing the base drag (boat tail) and a projectile base with reduction of the base drag by a gas generator (base bleed) are provided. The difference in range is achieved by attaching the payload-optimized boat tail or alternatively by a range-optimizing base bleed.

DE 38 19 640 A1, which corresponds to U.S. Pat. No. 4,930,420, which is incorporated herein by reference, discloses an artillery projectile with a pot-shaped base piece which contains a base bleed in order to increase the range of the corresponding projectile. The base piece is connected via a suitable connection to the projectile casing. An artillery projectile with at least one active unit is described in DE 10 2014 109 077 A1, which is incorporated herein by reference. The base piece is formed so as to be pot-shaped and closed at the tail side by a detachable cover part. In so far as an increased range of the artillery projectile is not required, an exchangeable second active unit is arranged in the base piece instead of a base bleed. This exhibits its action after or during activation of the first active unit. The final ballistic active power in the target area can thus be increased. The creation of a munitions construction kit is thus not possible and is also not planned.

Further components of the munitions construction kit include at least one projectile ogive and at least one detonator. The projectile ogive can be of one-part and also multi-part design. These can be used in the mouth hole of the projectile or the projectile casing. The respective detonator is accommodated by the projectile ogive and can also be regarded as a separate component.

Payloads as components or construction kit parts of the munitions construction kit determine the task of the artillery munition. These payloads include in particular insensitive high explosives (IHE), luminous, effect and smoke bodies as active bodies (payload).

In the case of an explosive projectile, IHE explosive inserts of varying length are provided as payload for the novel munition concept. The explosive insert is formed in this case by the insensitive high explosive (plastic-bonded explosive). This can be molded into a bag, e.g. rubber casing, in which the explosive hardens (e.g. in a mold). The bag or the rubber casing can simultaneously also serve as protection for the explosive in the projectile. Similar to DE 10 2013 021 030 A1, which is incorporated herein by reference, what are known as explosive modules can also be added to an explosive insert. The advantage of a prefabricated IHE explosive insert (one-part, multi-part) with a sheathing (rubber casing) lies in the fact that the problem of possible contact of the explosive charge with the projectile casing is ruled out.

For a luminous and effect projectile, the payload contains active bodies which generate IR light and/or light in the visual range, at least one. Effect projectiles can contain as payload at least one active body which generates a flash, a bang, etc. (what is known as shock munition). In the case of such projectiles, a volume equalization within the projectile casing can be advantageous. The payload can be accommodated in a barrier layer bag, e.g. plastic bag, which also serves as protection in particular during storage.

In the case of a smoke munition, the payload comprises at least one smoke body which is introduced into the projectile casing. In the case of a smoke projectile with shorter range, e.g. one more smoke body can be inserted into the projectile casing than in a projectile of greater range for the purpose of payload optimization.

As an result of the highlighted munitions construction kit, the user is provided with the possibility of being able to use an optimized munitions mix for training operation and/or deployment.

Assembly of the artillery projectile, e.g. 155 mm, to form an explosive projectile, a training projectile, a luminous projectile, an effect projectile or a smoke projectile can, as a result of this munition concept, be carried out in accordance with customer requirements prior to delivery of the munition to the user. As a result of the selection of the projectile tail, a payload-optimized or range-optimized projectile can be assembled. A maximum range with sufficient payload potential can be realized with e.g. a gas generator in the projectile base. In contrast, without a gas generator in the projectile base, a maximum payload potential with sufficient range can be created.

The various ranges for the artillery projectile can thus be adjusted with the selection of the projectile base. The overall length potential of the projectile casing and the weight for the payloads are fully exploited for both variants.

In the course of the assembly of the construction kit parts to form an artillery projectile, the payload is introduced from the rear into the projectile casing and the projectile casing is closed off by the selectable projectile base.

The projectile base of the projectile tail preferably has a rotated surface on the inside and outside which enables narrower tolerances in the manufacturing process. This is reflected in a higher precision of the projectile.

The logistics concept furthermore provides that all the important components/construction kit parts of the munitions kit can be stored individually during manufacture and/or with the units. All of the components can be GPS checked and monitored. Where necessary, at the request of a user/customer, the desired munition can thus be assembled and supplied to the desired handover location in a timely manner. From the stock, a quantity which can be defined or determined by the user, as immediate requirement for use, can be stored. The higher quantity, the consumer quantity, can then be supplied later from a logistics warehouse. If munition is supplied from the logistics warehouse, this can trigger a remanufacture of the components of the munition construction kit.

At least one packaging and/or at least one transport material are provided as part of the munitions construction kit for transport of the assembled artillery projectile or its components.

The new logistics concept is suitable for covering any immediate requirement, able to quickly provide larger munition allocations in a manner tailored to training operation/deployment, reduce the outlay of munition monitoring and quickly respond to new requests with new action mechanisms (qualified carriers). It is also associated with the reduction in classification. No new pilot batches are required.

Further advantages also arise from the proposed munition concept.

As a result of the separation of the artillery munition into independent construction kit parts (modules) or components, individual storage groups can be created. The safety aspects and requirements necessary for storage only have an impact on a few of the construction kit parts/components. Storage of an empty projectile casing is, for example, less problematic than a projectile casing filled with a payload. If an artillery munition is required, the corresponding construction kit parts of the artillery projectile are removed from the warehouses and assembled to form a functional artillery munition.

The use of a uniform projectile casing which is used for projectiles with various ranges is proposed. A projectile with a shorter range can be payload-optimized, while a projectile with the larger range is subject to range optimization alongside payload reduction. The payload of a projectile with a greater range is generally lower than in the case of a projectile with a shorter range. The artillery projectiles have a projectile casing of the same size for projectiles with different ranges. I.e., in order to create an artillery projectile, e.g. 155 mm, a uniform payload-optimized 30 km projectile casing is used, from which 40 km projectiles with payload reduction can be generated (produced, assembled). The range is selected and specified by different projectile bases. The artillery projectile comprises several construction kit parts which are assembled to create the artillery projectile.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
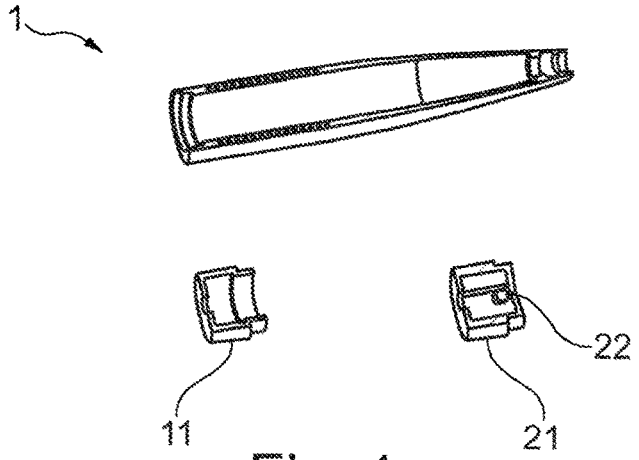
FIG. 1 shows a one-part projectile casing for an artillery munition with two different projectile bases in a sectional representation.
Figure 3A:
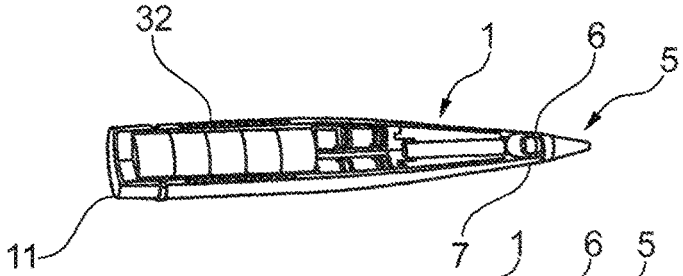
FIGS. 3*a* and 3*b* show the projectile casing from FIG. 1 with a payload-optimized or a range-optimized inner structure as an IR/visual artillery luminous projectile.
Figure 3B:
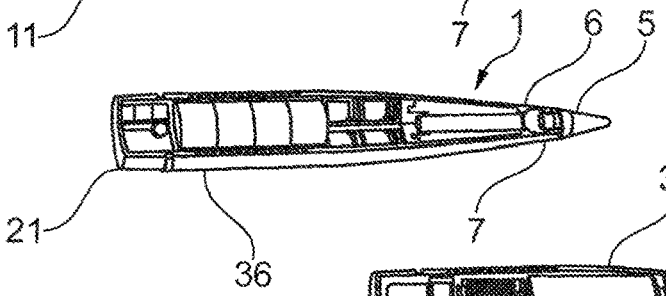
Figure 4A:
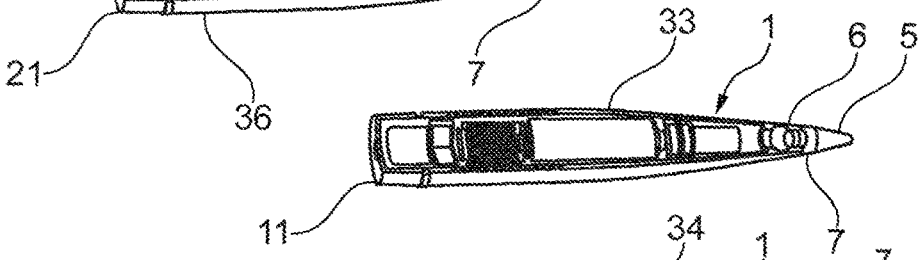
FIGS. 4*a* and 4*b* show the projectile casing from FIG. 1 with a payload-optimized or a range-optimized inner structure as an artillery smoke projectile.
Figure 4B:
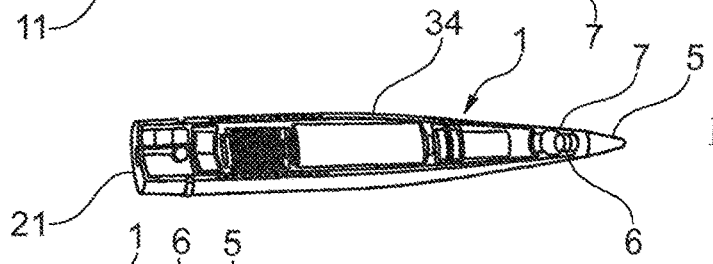

There is represented in FIG. 1 a projectile casing 1, as a uniform projectile casing, for an artillery projectile, for example 155 mm, with a shorter range, e.g. 30 km, and longer range, e.g. 40 km (FIGS. 3-5). Projectile casing 1 is preferably formed in one part, but can also be formed in several parts.

Projectile casing 1 can be closed off at the tail side 2 (projectile tail) by a projectile base 11 or 21. Projectile base 11 has no gas generator (boat tail), while projectile base 21 comprises a gas generator 22 (base bleed).

Figure 2A:
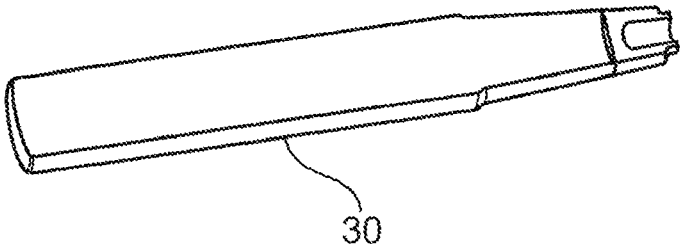
FIGS. 2*a* to 2*e* show payload inserts as an inner structure in a sectional representation.
Figure 2B:
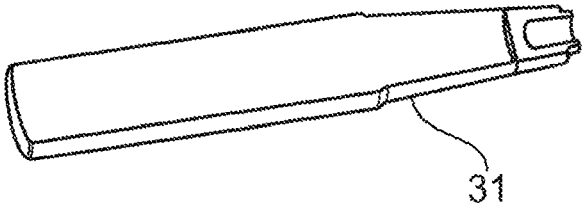

Various payload components 30, 31, 32, 33, 34, 35 are highlighted in FIGS. 2*a*)-*e*) which can form different artillery projectiles in accordance with the required function of the artillery munition (not represented in greater detail).

Two IHE explosive inserts 30, 31 of different lengths are depicted in FIGS. 2*a*) and 2*b*), for example an IHE explosive charge 30 with 10 kg charge and an IHE explosive charge 31 with 8 kg charge.

Figure 2C:
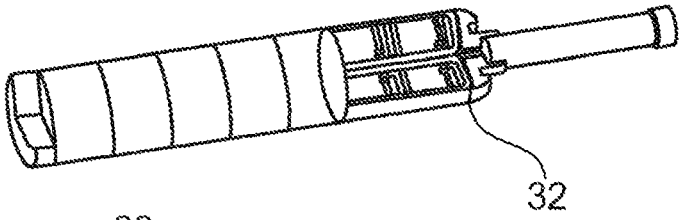
Figure 2D:
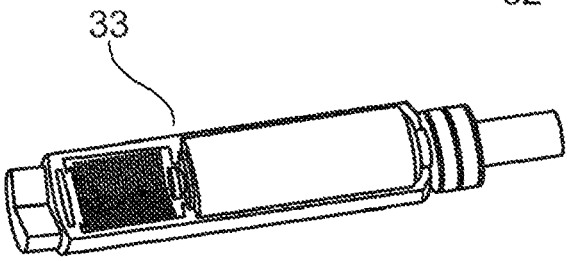
Figure 2E:
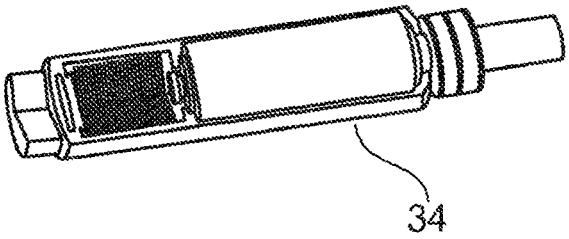

In FIG. 2*c*), payload 32 comprises several RP smoke bodies, while in FIGS. 2*d*) and 2*e*) payload component 34, 35 exhibits light sources (active bodies) which generate light in the IR or visual range.

According to the new munition concept, the artillery projectiles desired by the user can thus be assembled individually in particular prior to use with these components or construction kit parts. The user can thus aim for a payload-optimized or range-optimized artillery projectile 40-45.

If projectile casing 1 is in one part, the payload is introduced from tail side 2 of projectile casing 1. If projectile casing 1 is in multiple parts, the payload can be inserted.

In order to create a payload-optimized smoke munition 40, i.e. with shorter range, e.g. 30 km, a payload 32 with, for example, 7 RP smoke bodies (smoke masses) can be inserted into projectile casing 1. Projectile casing 1 is terminated here at the tail side by a projectile base 11 without gas generator.

If, however, the user desires a range-optimized smoke munition 41, i.e. with longer range, e.g. 40 km instead of 30 km, projectile casing 1 bears a payload 36 with, for example, 6 RP smoke bodies (smoke masses). A projectile base 21 with gas generator 22 can then be attached, for example screwed on at the tail side 2.

The user has the same possibility of selection in order to create a range-reduced or range-increased luminous projectile 42, 43. Here, either payload 34 or payload 35 is fitted into projectile casing 1. Adjustment of the max. range is then also carried out here by means of selected projectile base 11 or 21. For a shorter range (e.g. 30 km), projectile base 11, for a longer range (e.g. 40 km) projectile base 21 is fastened to projectile tail 2 of projectile casing 1.

Figure 5A:
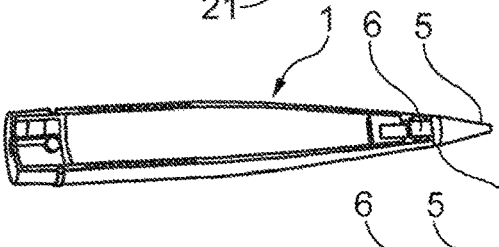
FIGS. 5*a* and 5*b* show the projectile casing from FIG. 1 with a payload-optimized or a range-optimized inner structure as an artillery explosive projectile.
Figure 5B:
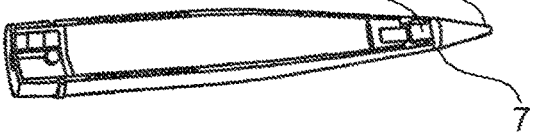

For a payload-optimized explosive projectile 44 (also explosive training projectile), longer or heavier explosive insert 30 is incorporated into projectile casing 1. Projectile tail 2 is terminated by projectile base 11, i.e. without gas generator (FIG. 5*a*). If, however, a range-optimized explosive projectile 45 (also explosive training projectile) is required, shorter or lighter explosive insert 31 is incorporated into projectile casing 1. For this embodiment, projectile tail 2 is terminated by projectile base 21 with gas generator (FIG. 5*b*).

At the nose side, a mouth hole 7 in projectile casing 1 accommodates a projectile ogive 5 which can have one part as well as several parts. A detonator 6 is located in projectile ogive 5 which can be used for each of artillery projectiles 40-45. This can be a proximity detonator, an impact detonator, etc.

The above-mentioned munition concept is not restricted to an artillery projectile in the high-caliber range (105 mm, 155 mm). It can, as desired, also be used in the low-caliber and medium-caliber range.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A munitions construction kit for artillery projectiles of varying range, the munitions construction kit comprising:

at least one uniform projectile casing;

at least one projectile base with a base drag reducing gas generator and at least one projectile base without the base drag-reducing gas generator;

at least two payloads having different lengths, each of the at least two payloads being self-enclosed units that are insertable into the uniform projectile casing; and a projectile ogive, wherein during construction of the artillery projectiles, the munitions construction kit allows for selection of either the at least one projectile base with the base drag-reducing gas generator or the at least one projectile base without the base drag-reducing gas generator as well as selection of one of the at least two payloads in order to modify ranges of the artillery projectiles.

2. The munitions construction kit as claimed in claim 1, wherein the projectile casing is a one-part or a multi-part structure.

3. The munitions construction kit as claimed in claim 1, wherein the projectile base is adapted to be fastened to a projectile tail of the projectile casing.

4. The munitions construction kit as claimed in claim 1, wherein a projectile with a shorter range is adapted to be payload-optimized and a projectile with a greater range is adapted to be range-optimized.

5. The munitions construction kit as claimed in claim 1, wherein the at least two payloads include at least one insensitive high explosive, a luminous, an effect or a smoke body.

6. The munitions construction kit as claimed in claim 5, wherein, in the case of an explosive projectile, IHE explosive inserts of varying length are provided as the at least two payloads.

7. The munitions construction kit as claimed in claim 5, wherein, in the case of a smoke projectile with a shorter range, at least one more of the smoke body is insertable into the projectile casing than in a projectile of a greater range.

8. The munitions construction kit according to claim 1, further comprising a detonator.

9. The munitions construction kit according to claim 1, wherein the at least two payloads having the different lengths include two payloads formed of a same material but having the different lengths or two payloads formed of different materials and having the different lengths.

10. A logistics concept for a projectile, comprising:

individually created storage groups for independent construction kit parts of a munitions construction kit, the independent construction kit parts including at least one uniform projectile casing, at least one projectile base with a base drag-reducing gas generator and at least one projectile base without the drag-reducing gas generator, at least two payloads having different lengths where each of the at least two payloads are self-enclosed units that are insertable into the uniform projectile casing, and a projectile ogive.

11. The logistics concept as claimed in claim 10, wherein the construction kit parts are stored individually during manufacture or stored individually with users.

12. The logistics concept as claimed in claim 10, wherein the construction kit parts are GPS checked and monitored.

13. The logistics concept as claimed in claim 10, wherein, at the request of a user, a desired projectile is assembled and supplied to the user at a desired handover location in a timely manner.

14. The logistics concept as claimed in claim 10, wherein a quantity which is defined by a user is present in a vicinity of the user, and further quantities, as a consumer quantity, are stored in a logistics warehouse.

15. The logistics concept as claimed in claim 10, wherein, in the event of a delivery of the construction kit parts from a logistics warehouse, a remanufacture of the construction kit parts is triggered.

* * * * *